US005993197A

United States Patent [19]

Alber et al.

[11] Patent Number: 5,993,197

[45] Date of Patent: Nov. 30, 1999

[54] COMBUSTION CHAMBER OF A BURNER FOR A VEHICLE HEATER OR AN EXHAUST GAS PARTICLE FILTER

[75] Inventors: Andreas Alber, Stuttgart; Walter Blaschke, Esslingen; Dirk Brenner, Stuttgart; Michael Humburg, Göppingen; Wolfgang Pfister, Esslingen; Peter Steiner, Aichwald, all of Germany

[73] Assignee: J. Eberspächer GmbH & Co., Esslingen, Germany

[21] Appl. No.: 08/666,536

[22] PCT Filed: May 6, 1995

[86] PCT No.: PCT/DE95/00614

§ 371 Date: Jul. 2, 1996

§ 102(e) Date: Jul. 2, 1996

[87] PCT Pub. No.: WO95/31348

PCT Pub. Date: Nov. 23, 1995

[30] Foreign Application Priority Data

May 13, 1994 [DE] Germany ..... 44 16 998
Nov. 29, 1994 [DE] Germany ..... 44 42 425

[51] Int. Cl.[6] ..... F23D 3/00

[52] U.S. Cl. ..... 431/261; 431/350; 431/352; 431/353; 29/890.02

[58] Field of Search ..... 431/350, 351, 431/352, 353, 261, 195, 196, 262, 8, 197, 198, 199, 200; 237/12.3 C; 29/890.02; 164/34, 35, 36

[56] References Cited

U.S. PATENT DOCUMENTS

| | | | |
|---|---|---|---|
| 1,227,239 | 3/1917 | Best | 431/198 |
| 1,373,144 | 3/1921 | Mummery | 431/198 |
| 2,582,890 | 1/1952 | Stamm . | |
| 4,538,413 | 9/1985 | Shinzawa . | |

FOREIGN PATENT DOCUMENTS

| | | |
|---|---|---|
| 334222 | 1/1977 | Austria . |
| 2139504 | 4/1976 | Germany . |
| 0078810 | 3/1990 | Japan . |

*Primary Examiner*—Carl D. Price
*Attorney, Agent, or Firm*—McGlew and Tuttle

[57] ABSTRACT

A combustion chamber of a burner for a vehicle heater or for thermal regeneration of an exhaust gas particle filter having a frontal boundary wall, a circumferential boundary wall, a connector for fitting a glow plug and a connector for conveying combustion air which projects from the frontal boundary wall into the combustion chamber and has at least combustion air outlets through the connector wall, in which the combustion chamber with the frontal boundary wall, the circumferential boundary wall, the glow plug connector and with or without the air supply connector takes the form of a one-piece precision-cast component.

36 Claims, 6 Drawing Sheets

COMBUSTION CHAMBER OF A BURNER FOR A VEHICLE HEATER OR AN EXHAUST GAS PARTICLE FILTER

FIELD OF THE INVENTION

The present invention pertains to the combustion chamber of a burner for a vehicle heater or for the thermal regeneration of an exhaust gas particle filter, which has a front limiting wall, a circumferential limiting wall, a socket for accommodating a glow plug, and a pipe for supplying combustion air, which pipe projects from the front limiting wall into the combustion chamber and has at least combustion air outlets through the pipe wall.

BACKGROUND OF THE INVENTION

Such combustion chambers of burners for these applications have been known. The prior-art combustion chambers were fitted together from punched and subsequently bent sheet metal parts, which involves considerable expenses for connecting the individual parts, normally by welding or soldering. These connection techniques usually lead to a thermal warping of the combustion chamber, so that the combustion chamber must be straightened before installation in the burner.

SUMMARY AND OBJECTS OF THE INVENTION

The basic object of the present invention is to make available a combustion chamber that can be manufactured efficiently.

To accomplish this object, the combustion chamber is designed as a one-piece precision casting component with the front limiting wall, with the circumferential limiting wall, with the glow plug socket, and with or without the air supply pipe.

Precision casting is a prior-art manufacturing process. However, the view that only the above-mentioned "sheet metal design" is suitable for manufacturing combustion chambers from suitable materials and with the desired thin wall thickness of the components, is a view that is widespread in the technical field of the present invention, and has stood in the way of designing a combustion chamber as a precision casting component. The inventors of the subject of the present invention have disregarded these concerns and have found that combustion chambers with reasonably thin wall thicknesses can be manufactured from a suitable material according to the precision casting process, contrary to expectations. The accuracy of manufacture is better without straightening operations than in the case of the sheet metal design. Only minimal finishing operations, e.g., the preparation of a fuel supply hole, are necessary at most.

The present invention offers the possibility of pursuing the precision casting integral design of the combustion chamber very far or less far. If the air supply pipe is included in the integral design, an especially good effect is achieved in terms of efficiency. However, advantages are offered over the prior-art design even by a precision casting component into which the air supply pipe, which itself is manufactured either from bent sheet metal or according to the precision casting process, is inserted subsequently. It will become clear from the further description that in a variant of the present invention, other functional components of the combustion chamber can also be included in the precision casting integral design.

A typical representative of the precision casting technology, which is preferred in the present invention, is the prior-art lost-wax process. A manufacturing mold is first prepared in this process for a wax pattern, which has the shape of the precision casting component to be ultimately prepared. A relatively large number of such wax patterns, connected to a common sprue, are then incorporated in a mold material, which frequently consists of ceramic particles with a binder. The wax patterns melt out during the subsequent casting, and the mold cavities formed as a result are filled with molten metal. The mold material is destroyed to remove the precision casting components.

Scaling-resistant and high-temperature steel alloys, especially steel alloys from the group of the stainless special steels, are preferably used as the material for the precision casting component according to the present invention.

The glow plug socket is preferably aligned at least essentially in parallel to the direction of the longitudinal extension of the combustion chamber and is designed as a bulge of the circumferential limiting wall. The bulge may have a sector-like cross-sectional shape, especially an essentially semicircular shape or a shape between a semicircle and three fourths of a circle. The glow plug socket is normally shorter in the direction of the longitudinal extension than the circumferential limiting wall.

The air supply pipe may be open toward the inside of the combustion chamber at its downstream end (as a result of which an end discharge of the combustion air is obtained), or this end may also be closed (so that it has only the combustion air outlets through the pipe wall). A flame retention baffle is preferably arranged downstream of the open end in the first case, and the flame retention baffle distributes the combustion air flow being discharged from the open end to the outside in the direction of the circumferential limiting wall, so that this flow supplies the oxygen there for the complete combustion of the fuel. The flame retention baffle is preferably a plate bent convexly toward the air supply pipe. The flame retention baffle may be a separate component mounted subsequently, but it may also be part of the precision casting discussed above.

In many cases, it is desirable for the combustion chamber to have a mounting flange for fastening it in the burner as a whole, and the mounting flange extends at right angles to the direction of the longitudinal extension of the combustion chamber in most cases. The above-mentioned precision casting component preferably has the mounting flange made in one piece with it. It is most favorable from the viewpoint of manufacture for the mounting flange to be located radially on the outside at least essentially in the extension of the front limiting wall.

The air supply pipe has hitherto been consistently tubular with distributed perforations in the pipe wall. According to a second aspect of the present invention, the air supply pipe has longitudinal slots as combustion air outlets in the pipe wall. Part of the longitudinal slots or all longitudinal slots reach up to the downstream end of the air supply pipe. The longitudinal slots can be manufactured in a markedly simpler manner than hole-like openings in the pipe wall according to the precision casting technology. However, the provision of longitudinal slots does not rule out the additional presence of hole-like combustion air outlets in the pipe wall.

It is pointed out expressly, on the one hand, that the described configuration of the air supply pipe with longitudinal slots represents a preferred variant of the above-described, first aspect of the present invention ("combustion chamber manufactured according to the precision casting technology"), especially because an air supply pipe with longitudinal slots can be manufactured more conveniently according to the precision casting technology, and, on the other hand, that the described second aspect of the present invention represents an independent invention, which can also be embodied in a technically advantageous manner separated from the idea of the precision casting technology.

One longitudinal slot, some longitudinal slots, or all longitudinal slots may have constant width over the longitudinal direction of the slot, measured in the circumferential direction of the air supply pipe. However, it is also possible for one, some or all longitudinal slots to have a width increasing in the longitudinal direction of the slot toward the downstream end, measured in the circumferential direction of the air supply pipe. The latter measure leads to the welcome result that a relatively small amount of combustion air passes over at the upstream end of the combustion chamber from the air supply pipe into the combustion space of the combustion chamber, whereas a relatively larger amount of combustion air passes over into the combustion space of the combustion chamber closer to the downstream end of the air supply pipe, and it is available there for the complete combustion of the combustion air. This is an example of the situation in which the downstream end of the air supply pipe may be designed as a closed end, because sufficiently large air discharge cross sections are available in the downstream end area of the air supply pipe through the pipe wall.

In a preferred variant of the present invention, at least one of the combustion air outlets through the pipe wall is designed such that the combustion air is discharged with a flow component in the circumferential direction of the air supply pipe. It is achieved as a result that the combustion air is not discharged essentially in the radial direction, but with a more or less pronounced flow component in the circumferential direction, so that a swirling flow is formed in the combustion space; this is favorable for the combustion process of the fuel in the combustion chamber.

It is also preferable to design the air supply pipe with an inner cross section tapering in the direction of flow. As a result, a flow cross section increasing in the direction of flow is made available to the hot, expanding combustion gases in the annular combustion space between the circumferential limiting wall and the air supply pipe.

The combustion chamber according to the present invention is preferably designed as an evaporative combustion chamber. A porous lining for evaporating the fuel may be provided for this purpose on the inside at the front limiting wall and/or the circumferential limiting wall. The lining does not have to completely cover the front limiting wall and/or the circumferential limiting wall. Porous lining may, but does not have to, be provided in the interior of the glow plug socket as well. Conventional materials for the porous lining are fibrous webs, especially those made of ceramic fibers, or fiber metal materials. It is obvious that fuel is supplied from the outside to the porous lining, and the fuel evaporates from the lining into the combustion space.

According to a third aspect of the present invention, a combustion chamber is provided, whose lining consists of sintered metal. This third aspect of the present invention represents, on the one hand, a preferred embodiment of the above-described invention, but, on the other hand, it also represents an independent invention, which can be advantageously embodied separated from the precision casting technology described herein. A porous lining made of sintered metal is substantially more durable than a fibrous web made of ceramic fibers, and it can be manufactured with highly uniform porosity and a high accuracy of fit, and it offers an optimal contact with the combustion chamber wall in question. Furthermore, it is possible to use the same material or a similar material as for the other functional components of the combustion chamber, so that the recycling of the combustion chamber is facilitated. Finally, the thickness of the lining can be varied from one area to the next as needed.

According to a preferred variant of the present invention, the sintered metal lining may be prepared in situ in the combustion chamber by introducing the material of the lining, i.e., the particles to be sintered, into the combustion chamber in the non-sintered state and sintering it there in situ. A core is normally inserted for this purpose into the combustion chamber, so that a gap-like shaping space, into which the particles to be sintered are then filled, is formed between the front limiting wall and the circumferential limiting wall, on the one hand, and the core, on the other hand. The sintering is carried out in the usual manner by supplying heat. The in situ sintering leads to optimal contact between the lining and the corresponding limiting wall of the combustion chamber.

According to a fourth aspect of the present invention, a guide and guard ring projecting by a certain amount from the front limiting wall to the interior of the combustion chamber is arranged between the circumferential limiting wall and the air supply pipe. The guide and guard ring brings about a more axial flow of the combustion air discharged from the air supply pipe in the upstream end area, and, what is especially important, it prevents unburned fuel from dripping onto the air supply pipe, which is hot during the operation, which would imply the considerable risk of coking of the air supply pipe or even a partial or complete clogging of combustion air outlets, which leads to the risk that the combustion of the fuel will no longer take place properly.

It is pointed out expressly that, on the one hand, this fourth aspect of the present invention represents a preferred embodiment of individual or several of the above-described aspects of the present invention, but, on the other hand, it represents an independent invention, separated from the idea of precision casting described herein, because the design according to the fourth aspect of the present invention can also be used independently herefrom in a technically advantageous manner.

The guide and guard ring does not absolutely have to be a full 360° circle. In the case of lower requirements, it may be sufficient for it to extend as a partial ring over a part of the circumference of the combustion chamber, especially where fuel can be expected to be most likely to drip onto the air supply pipe.

The downstream end area of the guide and guard ring is preferably designed such that it exerts a turbulence-increasing effect on the combustion air flow, i.e., it promotes the mixing of evaporated fuel and combustion air there.

With the exception of the glow plug socket, the combustion chamber according to the present invention may, but does not compulsorily have to, have essentially a configuration that is cylindrical in the front view.

According to a fifth aspect of the present invention, the end of the lining that is closer to the front limiting wall of the combustion chamber and/or the end of the lining that is farther away from the front limiting wall of the combustion chamber is fixed in an annular gap that is circumferentially continuous or is divided into sections. Based on this design, the lining can be fixed in the combustion chamber in an extremely simple manner in terms of production technology.

It can be achieved that the number of welding spots usually used until now to fasten the lining in the combustion chamber can be considerably reduced, or welding spots can be abandoned altogether. A fixing ring that is circumferentially continuous or is divided into sections, or a component fastened to a flame tube forming an extension of the combustion chamber may be preferably provided to form the annular gap.

It is pointed out expressly that, on the one hand, this fifth aspect of the present invention represents a preferred embodiment of individual or several of the above-described aspects of the present invention, but, on the other hand, it represents an independent invention, separated from the idea of a precision casting component described herein, because the design according to the fifth aspect of the present invention can also be embodied independently herefrom in a technically advantageous manner.

The fixing ring for the end of the lining that is closer to the front limiting wall is preferably part of the precision casting component. The fixation of the position of the lining can be perfected by bending the fixing ring at least at its free end toward the lining after the insertion of the lining, as a result of which the lining will be clamped. It may be favorable for this purpose to make the fixing ring with a thin wall thickness at its free end, so that it can be readily bent off there. Bending off is especially facilitated in the case of the fixing ring divided into sections as well.

The end of the lining can be inserted into the annular gap-like space in an especially simple manner if this space, when viewed in its longitudinal section, tapers toward its closing end and/or the lining has a tapering end. It is especially preferred, precisely in the case of the fastening of the lining according to the fifth aspect of the present invention, to provide the lining only at the circumferential limiting wall of the combustion chamber, so that the lining as a whole has a tubular rather than a pot-shaped configuration.

According to a sixth aspect of the present invention, the circumferential limiting wall of the combustion chamber has inside a projection extending in the direction of the longitudinal extension of the combustion chamber for the positive-locking fixation of the lining against movements in the circumferential direction. Thus, the fixation in the circumferential direction does not have to be ensured by the rest of the fixation of the position of the lining. In addition, it is achieved that the lining can be introduced into the combustion chamber in a defined position only (relative to rotation around the longitudinal axis of the combustion chamber), so that, e.g., an opening in the lining, which is to be positioned opposite the socket for the glow plug, will be automatically located at the correct position.

It is pointed out expressly that, on the one hand, this sixth aspect of the present invention represents a preferred embodiment of individual or several of the above-described aspects of the present invention, but, on the other hand, it represents an independent invention, separated from the idea of the precision casting component described herein, because the design according to the sixth aspect of the present invention can also be embodied independently herefrom in a technically advantageous manner.

According to a seventh aspect of the present invention, a device for generating flow swirl is provided in the flow path of the combustion air in front of the air supply pipe. The swirled combustion air flow leads to a more optimal formation of a fuel-air mixture favorable for combustion.

It is pointed out expressly that, on the one hand, this seventh aspect of the present invention represents a preferred embodiment of individual or several of the above-described aspects of the present invention, but, on the other hand, it represents an independent invention, separated from the idea of precision casting component described herein, because the design according to the seventh aspect of the present invention can also be embodied independently herefrom in a technically advantageous manner.

The device for generating flow swirl is preferably at least largely a part of the precision casting or is at least largely a part of the housing of a combustion air blower arranged in front of the combustion chamber. The device may have, in particular, a distributor, a flow space limited in a spiral pattern on the circumference, etc.

According to an eighth aspect of the present invention, a fuel distribution channel, which extends at least over part of the circumference of the circumferential limiting wall, is provided at the transition between the circumferential limiting wall of the combustion chamber and the lining. It is achieved due to the fuel distribution channel that the fuel fed in is distributed over a larger area from the lining even on the rear side. The consequences of this are a more uniform evaporation of the fuel over a larger area of the lining and a reduction of the risk of fuel dripping from the lining.

It is pointed out expressly that, on the one hand, this eighth aspect of the present invention represents a preferred embodiment of individual or several of the above-described aspects of the present invention, but, on the other hand, it represents an independent invention, separated from the idea of the precision casting component, because the design according to the eighth aspect of the present invention can also be embodied independently herefrom in a technically advantageous manner.

A fuel supply pipe opening into the fuel distribution channel for supplying fuel essentially in the circumferential direction is preferably provided. Achieving the advantages discussed above is further facilitated by such a fuel supply pipe.

According to a ninth aspect of the present invention, a heat conduction finger is provided radially farther out than the circumferential limiting wall of the combustion chamber, and the end of this heat conduction finger is located farther forward in the direction of longitudinal extension of the combustion chamber than its root, and a temperature sensor, with which it can be determined whether or not combustion is taking place in the combustion chamber, is arranged on the outside of the combustion chamber component in the area in which the root of the heat conduction finger is located on the inside of the combustion chamber component.

Burners for vehicle heaters or for the thermal regeneration of exhaust gas particle filters have usually also been equipped with so-called flame recognition or flame interruption recognition means until now. When it is determined by means of this device that no combustion process is still taking place or is no longer taking place in the combustion chamber in an unintended manner, at least the supply of fuel to the combustion chamber is interrupted in order to prevent unburned fuel from accumulating here in an uncontrolled manner. A temperature sensor, which recognizes the interruption of the flame from a decreasing wall temperature, has hitherto been normally provided for this purpose on the wall of the heat exchanger arranged downstream of the combustion chamber. However, this technique requires the provision of a hole through the outer wall of the heat exchanger; problems arise in this case in terms of sealing and corrosion, especially in the case of a combustion gas/water heat exchanger.

According to the ninth aspect of the present invention, the site of installation of the temperature sensor is displaced to the combustion chamber component; this leads to a markedly simplified manufacture, and problems of the above-described type are avoided. The heat conduction finger is preferably part of the precision casting component.

It is pointed out expressly that, on the one hand, the ninth aspect of the present invention represents a preferred embodiment of individual or several of the above-described aspects of the present invention, but, on the other hand, it represents an independent invention, separated from the idea of the precision casting component described herein, because the design according to the ninth aspect of the present invention can also be embodied independently herefrom in a technically advantageous manner.

According to a tenth aspect of the present invention, at least part of the surfaces on which carbon-containing deposits tend to be formed during the operation is made as copper-containing surfaces. The following surfaces shall be mentioned in particular as examples of the surfaces that may be considered for a copper-containing design: The inside of the lining for evaporating the fuel, the outside of the air supply pipe, the inside of the socket for the glow plug, limiting walls of the combustion chamber (especially if or where no lining is present), the flame tube arranged downstream of the combustion chamber, and the combustion gas-side surface of the heat exchanger.

Despite all the design efforts, areas with oxygen deficit, in which carbon-containing deposits may be formed, do sometimes occur in combustion chambers. The combustion temperature of such deposits is very greatly reduced by the copper-containing design (a reduction to 200° C. to 250° C. can be achieved). Since such temperatures are reached everywhere in the combustion chamber, especially if the operation is not only a short-term operation, a self-cleaning effect is observed. Keeping the surfaces of the above-mentioned type free from carbon-containing deposits is significant for the trouble-free operation and the long service life of the combustion chamber.

It is pointed out expressly that, on the one hand, this tenth aspect of the present invention represents a preferred embodiment of individual or several of the above-described aspects of the present invention, but, on the other hand, it represents an independent invention, separated from the idea of the precision casting component described herein, because the design according to the tenth aspect of the present invention can also be embodied independently herefrom in a technically advantageous manner.

A number of technical possibilities are available for realizing the copper content. It is possible to select copper-containing alloys or to provide a coating with a copper-containing material. In the case of a fibrous lining for evaporating the fuel, fibers of a copper-containing material may be mixed with the lining material. In the case of a sintered metal lining for evaporating the fuel, particles of a copper-containing material may be added to the particles to be sintered. The term "copper-containing material" used above also includes pure copper and copper alloys.

The combustion chamber according to the present invention is preferably part of a burner for a vehicle heater or part of a burner for the thermal regeneration of an exhaust gas particle filter. Vehicle heaters are used especially for passenger cars, the driver's cabs of trucks, buses, sailboats and motor boats, construction equipment, motor homes, camping trailers, and the like. In many cases, the vehicle has an internal combustion engine as a drive. The vehicle heater can be connected in this case into the coolant circulation and the regular heating circulation of the internal combustion engine, so that the vehicle heater can be used as an auxiliary heater if the amount of heat supplied by the internal combustion engine is insufficient and/or as a stand-by heater for use when the internal combustion engine is not running. Exhaust gas particle filters have been increasingly installed in the exhaust gas line of stationary diesel engines or diesel engines used to drive vehicles. The particle filters, frequently also called simply "soot filters," retain the particles contained in the exhaust gas of diesel engines. The particle filters must be freed from the particles filtered out, normally at intervals, which can be done especially by thermal regeneration. For thermal regeneration, the gas flow flowing to the particle filter is heated so intensely that the inflammation point of the particles, equaling about 650° C. to 700° C., is reached, and the particles are burned by the oxygen contained in the gas flow supplied.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENT

The same reference numbers are used for the same or analogous parts in all exemplary embodiments.

Figure 1:
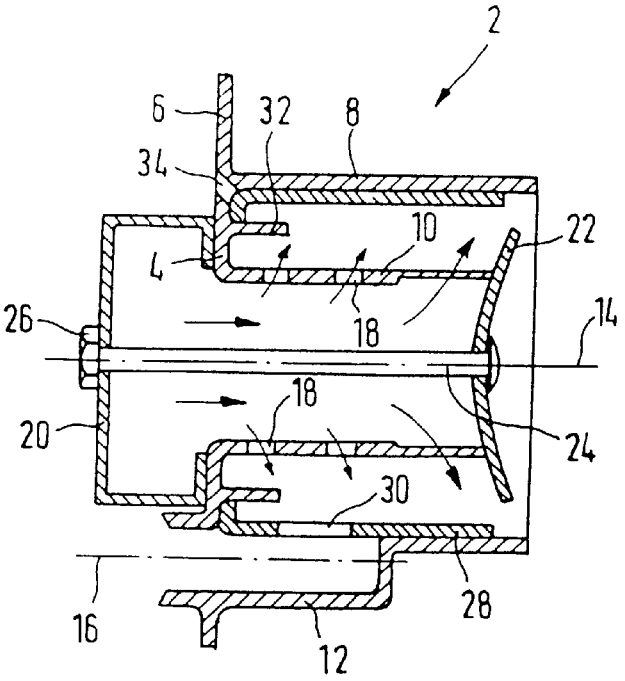
FIG. 1 is a longitudinal sectional view of a combustion chamber.
Figure 8:
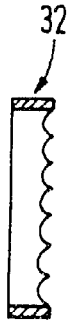
FIGS. 8 through 12 are views of various design variants of a guide and guard ring in a view developed into a plane.
Figure 9:
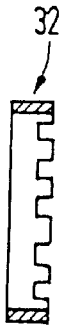
Figure 10:
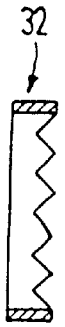

The combustion chamber 2 shown in FIG. 1 comprises essentially a flat front limiting wall 4, which passes over radially on the outside into a mounting flange 6; a cylindrical circumferential limiting wall 8, which projects from the front limiting wall 4 at right angles to the right; a cylindrical air supply pipe 10, which projects centrally from the front limiting wall 4 at right angles to the right; and a glow plug socket 12. The mounting flange 6 has a round outer circumference. The air supply pipe 10 is concentric with the circumferential limiting wall 8, but its diameter is smaller than that of the circumferential limiting wall 8, so that an annular space is formed between the air supply pipe 10 and the circumferential limiting wall 8.

The longitudinal central axis of the combustion chamber 2 is designated by 14. Measured in the axial direction, the air supply pipe 10 is about half as long as the circumferential limiting wall 8. Viewed in the cross section, not shown, the glow plug socket 12 has a sector-like inner contour, which extends over about 240°. The partial circumferential wall of the glow plug socket 12 forms, as it were, a bulge of the circumferential limiting wall 8, and the circumferential limiting wall 8 is interrupted where the glow plug socket 12 is connected. To the right, the glow plug socket 12 does not reach the end of the circumferential limiting wall 8. The longitudinal central axis 16 of the glow plug socket 12 is located somewhat outside the circumferential limiting wall 8 and is parallel to the axis 14. The wall of the air supply pipe 10 has radial, round holes 18 as combustion air outlets, distributed on the circumference and axially next to each other in two rows.

A plurality of webs 20 are provided, distributed over the circumference, at the downstream end of the air supply pipe 10, which is the right-hand end in FIG. 1, in the axial extension. The air supply pipe 10 is open at the upstream end, which is the left-hand end in FIG. 1, and at the downstream end, which is the right-hand end in FIG. 1 (i.e., the beginning of the webs 20).

All the components of the combustion chamber 2 discussed so far are designed together as an integral precision casting component. However, it is pointed out that as an alternative, the air supply pipe 10 may also have been prepared separately and subsequently united with the precision casting component.

An essentially cylindrical air supply housing 19, which may, but does not have to, contain a distributor for generating a swirled flow entering the air supply pipe 10, is attached on the left to the front limiting wall 4. A blower, not shown, which delivers the combustion air with the necessary overpressure, is connected to the air supply housing 19.

A plate 22, bent convexly to the left, which acts as a flame retention baffle and is pulled against the webs 20 by means of a small, centrally and axially extending rod 24, is arranged from the right at the free ends of the webs 20. At the left-hand end, the small rod 24 passes through the end front wall of the air supply housing 19 and is fastened by a screwed-on nut 26 there. The curved plate 22 consists of sheet metal. However, it could also be incorporated in the precision casting component integrally with the webs 20; the small rod 24 would be dispensable in this case.

FIG. 1 also shows a porous lining 28 inside at the front limiting wall 4 and inside at the circumferential limiting wall 8. The porous lining 28 preferably consists of sintered metal and has preferably been sintered in situ there. The lining 28 is somewhat shorter in the axial direction in the exemplary embodiment shown than the circumferential limiting wall 8, but it could also be just as long or even longer than the circumferential limiting wall 8. In the area in which the inside of the glow plug socket 12 passes over into the inside of the combustion chamber 2, i.e., the annular space between the circumferential limiting wall 8 and the air supply pipe 10, the lining 28 has an opening 30, whose size is only a fraction of that of the interruption of the circumferential limiting wall 8 provided there, but it may practically also have the full size of the interruption. With the combustion chamber 2 installed in the overall burner, the area of a glow plug, which will glow during the flow of current, be it a glow plug with a spiral-wound filament or a sheathed element glow plug, is accommodated in the glow plug socket 12.

Finally, FIG. 1 shows a guide and guard ring 32, which extends at right angles from the front limiting wall 4 to the right into the annular space between the circumferential limiting wall 8 and the air supply pipe 10. The axial length of the ring 32 is 5% to 30% and preferably 8% to 20% of the axial length of the air supply pipe 10. The ring 32 is preferably made in one piece with the precision casting component.

In the top left part of FIG. 1, a 45° oblique hole 34 is provided for supplying fuel, and a tube, not shown, may be inserted into the hole 34 by force fit. For convenience of illustration, the hole 34 is shown in the portion as per FIG. 1. In reality, the hole 34 is located rotated by 150° in relation to the position shown, next to the glow plug socket 12.

The combustion chamber 2 is usually installed with the glow plug socket 12 located on top, i.e., rotated by 180° around its longitudinal axis 14 compared with FIG. 1.

The combustion chamber 2 described operates during operation as follows:

Fuel, i.e., usually diesel fuel or gasoline, is supplied to the lining 28 via a metering pump and through the hole 34. To start up the combustion chamber 2, electric current is supplied to the glow plug, not shown, after which its front area begins the glow. Supported by the heating by means of the glow plug, fuel evaporates from the lining 28 to the inside of the combustion chamber 2, but also into the interior of the glow plug socket 12. The fuel-air mixture will then ignite at the glow plug, and the flame generated propagates through the opening 30 and into the annular space between the circumferential limiting wall 8 and the air supply pipe 10. At the same time, combustion air flows from the air supply housing 20 through the air supply pipe 10 and from there through the radial holes 18 into the above-described annular space, where the initial combustion of the fuel-air mixture takes place. Farther downstream, the major part of the combustion air flows through the large intermediate spaces between the webs 20 to the outside into the combustion space of the combustion chamber 2. The complete combustion of the fuel takes place there and farther downstream. Due to the guide and guard ring 32, a low-flow annular pocket, in which a rich fuel-air mixture can be formed, is formed radially outside of the guide and guard ring 32. Fuel dripping down from the lining 28 reaches the ring 32 instead of the air supply pipe 10 and is carried away by the combustion air downstream from the downstream edge, which is the right-hand edge in FIG. 1.

The glow plug socket 12 may also have a small opening, not shown, for supplying a small amount of scavenging air.

Figure 2:
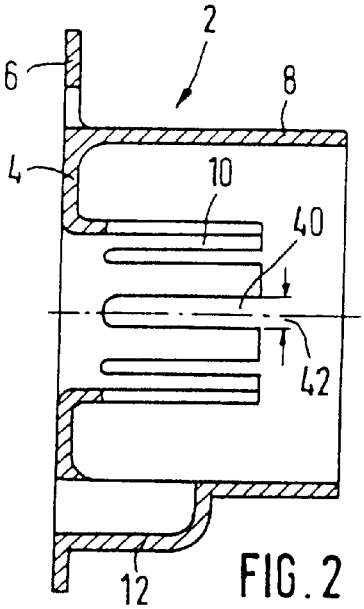
Figure 3:
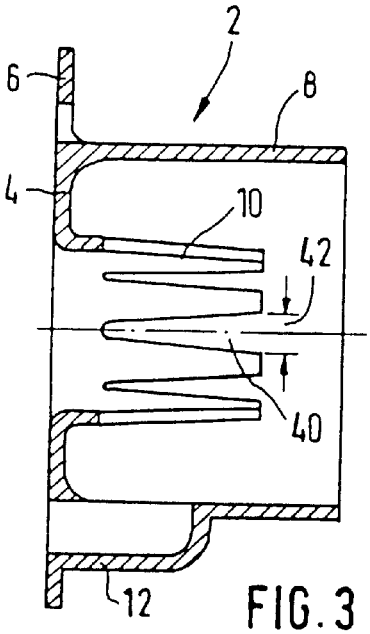

FIG. 2 shows a design of the air supply pipe 10, in which longitudinal slots 40, which begin somewhat behind the upstream end of the pipe 10 and pass through to the downstream end of the pipe 10, are provided instead of the round holes 18. The longitudinal slots 40 are uniformly distributed over the circumference of the pipe 10 and have, measured in the circumferential direction of the pipe 10, a constant width 42 in the axial direction. A flat or arched plate, corresponding to the plate 22 in FIG. 1, may be placed directly on the downstream end of the pipe 10. As an alternative, webs 20 may be integrally cast in the axial extension of the pipe 10, as in the embodiment according to FIG. 1; the plate, not shown, would now be in contact with the free ends of these webs FIG. 3 shows a variant, in which the longitudinal slots have, measured in the circumferential direction of the pipe 10, a width 42 progressively increasing in the direction of flow.

Figure 4:
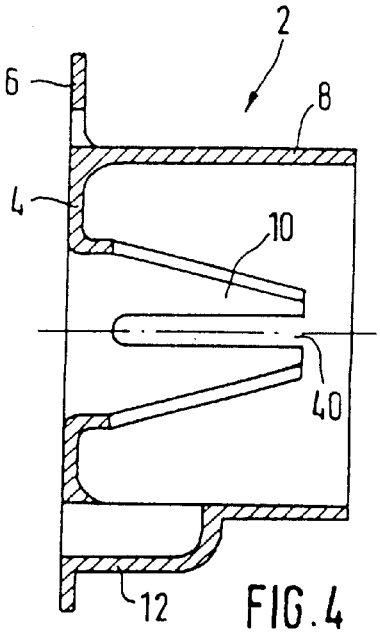

The pipe 10 conically tapers in the direction of flow in the variant shown in FIG. 4.

Figure 5:
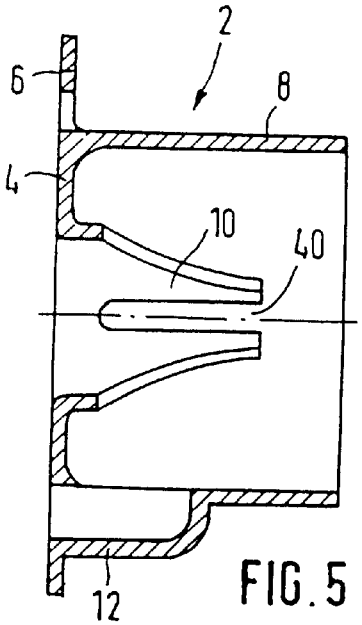
FIGS. 2 through 5 is a longitudinal sectional view and somewhat more schematic representations of a combustion chamber component, in which alternative embodiments of the combustion air pipe are shown.

FIG. 5 shows a variant, in which the taper of the pipe 10 arches inwardly.

Figure 6:
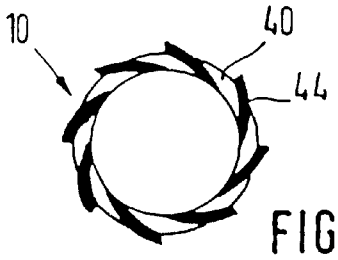
FIGS. 6 and 7 are views of two more alternative embodiments of the combustion air pipe in a cross-sectional view.
Figure 7:
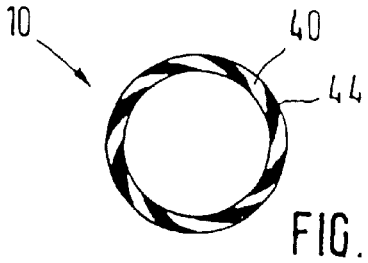

FIGS. 6 and 7 show cross sections of embodiments of the pipe 10, in which longitudinal slots 40 and pipe wall areas 44 alternate with one another. The longitudinal slots 40 are shaped here such that they force the combustion air to be discharged with a flow component in the circumferential direction of the pipe 10.

As in the exemplary embodiment according to FIG. 1, the front limiting wall 4, the circumferential limiting wall 8, the mounting flange 6, the air supply pipe 10, and the glow plug socket 12 are designed as a one-piece precision casting component in all exemplary embodiments according to FIGS. 2 through 7.

Figure 12:
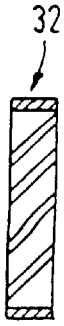
Figure 11:
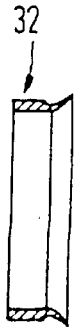

FIGS. 8 through 12 show various variants of the design of the guide and guard ring 32. In the embodiments according to FIGS. 8 through 10, the downstream end edge of the ring 32 is profiled, so that turbulence is imparted to the part of the combustion air flowing past there or the turbulence of this part of the combustion air is increased. FIG. 11 shows a design of the downstream end of the ring 32 as a sharply pointed, outwardly bent injection-molded edge. FIG. 12 shows a design of the ring with obliquely extending grooves or projections on the inside to impart a swirl to the air flowing past there. It would also be possible to provide corresponding grooves or projections on the outside of the ring 32 for guiding fuel dripping on it in the spiral direction. The ring 32 does not have to be cylindrical, but it could also be conical, tapering or widening in the downstream direction.

Figure 13:
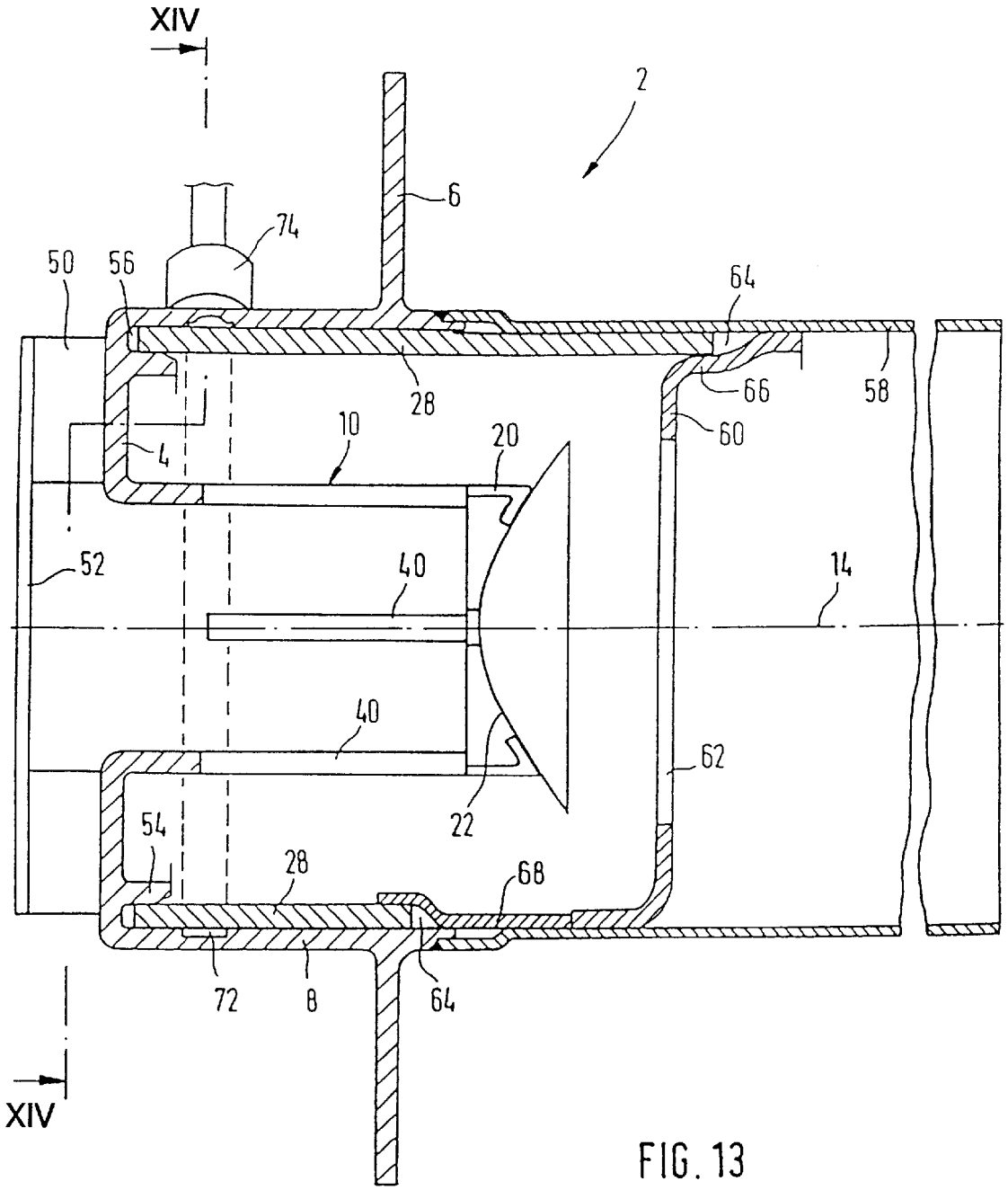
FIG. 13 is a longitudinal sectional view of a combustion chamber of another design, in which two different variants are shown at the top and at the bottom.
Figure 14:
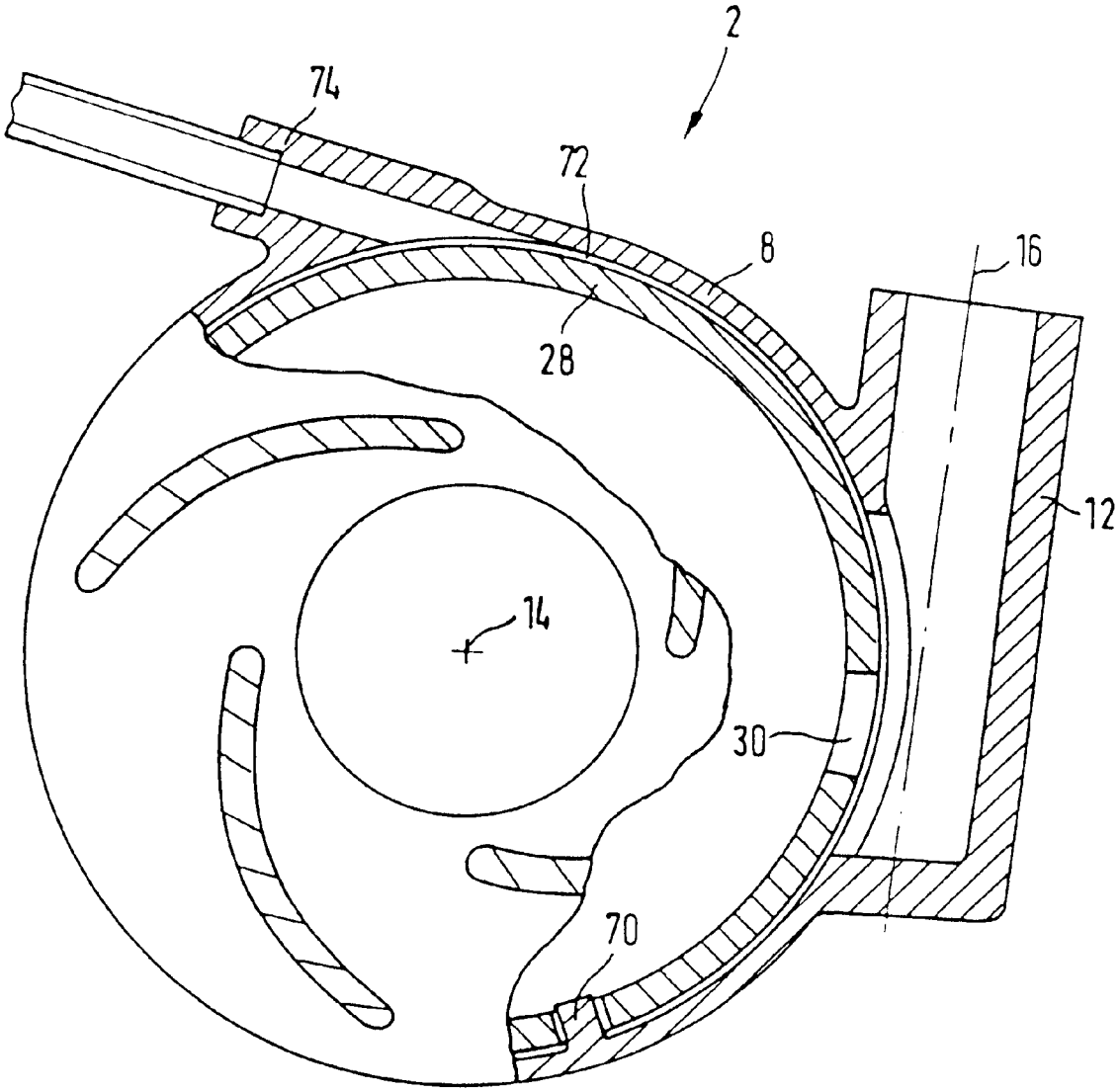
FIG. 14 is a cross sectional view along XIV—XIV of the combustion chamber according to FIG. 13.

The combustion chamber 2 shown in FIGS. 13 and 14 has, insofar as it is analogous to the combustion chamber 2 in FIG. 1, a flat front limiting wall 4, a cylindrical circumferential limiting wall 8, a cylindrical air supply pipe 10, a glow plug socket 12, and a mounting flange 6, which extends, however, farther to the right from the circumferential limiting wall 8 in the radial outer direction than in the embodiment according to FIG. 1. As in the exemplary embodiment according to FIG. 2, the air supply pipe is provided with longitudinal slots 40. All the parts of the combustion chamber 2 discussed up to now are designed together as an integral precision casting component. However, it is pointed out that as an alternative, the air supply pipe 10 may also have been manufactured separately and subsequently united with the precision casting component.

Unlike the embodiment according to FIG. 1, the combustion chamber 2 according to FIGS. 13 and 14 has a distributor for generating flow swirl in the combustion air flowing to the air supply pipe 10, whose curved guide vanes 50 are integrally cast with the precision casting component of the combustion chamber. The guide vanes 50 occupy somewhat less space in the radial direction than the space of the front limiting wall 4 and extend directly from this radially to the left in FIG. 13. On the side facing away from the front limiting wall 4, the guide vanes 50 are covered by a round, continuous plate 52, so that the combustion air must flow into the flow channels between the guide vanes 50 exclusively radially from the outside, and it enters the air supply pipe 10 with a very substantial swirl around the longitudinal central axis 14 of the combustion chamber 2. The plate 52 may also be cast integrally with the precision casting component, but it may also be a part that is manufactured separately and is subsequently put in place and fastened.

As an alternative, the device for generating flow swirl may preferably be formed by a flow space with spirally extending circumferential wall, which is arranged in front of the air supply pipe 10. The combustion air can be fed into this flow space tangentially at the limiting wall, which extends with a decreasing radius of curvature. The flow space described may be provided in a correspondingly thick housing wall of a combustion air blower arranged in front of the combustion chamber 32; cf., e.g., housing wall 80 in FIG. 17.

Furthermore, FIG. 13 shows a novel fastening of the porous lining 28 in the combustion chamber 2. It should first be pointed out that the lining 28 is simply cylindrical and consequently not pot-shaped as in the exemplary embodiment according to FIG. 1; the lining 28 is consequently provided inside at the circumferential limiting wall 8, but not inside at the front limiting wall 4. A fixing ring 54 extends to the right in FIG. 13 from the front limiting wall 4 to the inside of the combustion chamber 2, doing so at a radially spaced location from the inside of the circumferential limiting wall 8, which corresponds essentially to the radial thickness of the lining 28. The end of the lining 28, which is the left-hand end in FIG. 13, is pushed into the annular gap 56 thus formed between the circumferential limiting wall 8 and the fixing ring 54, and the fixing ring 54 is somewhat beveled on the outside on the right to make it easier to push it in.

Two different variants are shown in FIG. 13 above the longitudinal central axis 14 and below the longitudinal central axis 14 concerning the fastening of the end of the lining 28, which is the right-hand end in FIG. 13. A flame tube 58, which is shown as an interrupted plate in FIG. 13, but is considerably longer in the axial direction than the combustion chamber 2, is fitted to the described precision casting component of the combustion chamber 2, continuing to the right. A flame screen 60, which consists of a plate and has a large central flow opening 62, which locally constricts the gas flow in comparison with the internal diameter of the circumferential limiting wall 8 or of the flame tube 58, is fastened in the flame tube 58 at a certain distance from its left-hand end.

In the variant shown in the top part of FIG. 13, the flame screen 60 is bent off at the transition for fastening in the flame tube 58 such that an annular gap 64 remains between the flame tube 58 and an area 66 of the flame screen extending essentially in parallel to the flame tube 58. The end of the lining 28, which is the right-hand end in FIG. 13, is pushed into this annular gap 64, so that the described area 66 of the flame screen 60 acts as a fixing ring for the lining 28. The lining 28 is relatively long in the axial direction, i.e., it extends somewhat from the circumferential limiting wall 8 into the flame tube 58.

In the variant shown in the bottom part of FIG. 13, the lining 28 ends on the right-hand side before the end of the circumferential limiting wall 8 is reached. A ring-shaped component 68 is fastened to the flame tube 58 in its end areas, which is the lefthand end area in FIG. 13, and this ring-shaped component 68 extends to the left and is bent inwardly in a stepped manner at the left-hand end, so that an annular gap 64 (analogous to the annular gap 64 in the top part of FIG. 13) is formed there to accommodate the right-hand end of the lining 28.

If the flame tube component 58 is pushed onto the combustion chamber component 2 to the left and is fastened there by welding, the right-hand end of the lining 28 is also accommodated, as was described, in the corresponding annular gap 64. The lining 28 is fixed by the clamping at both ends at the inner circumference of the circumferential limiting wall 8. The radial dimensions of the annular gaps 56 and 64 may, but do not have to, be such that the ends of the lining 28 are accommodated with a certain clamping; to facilitate assembly, the ends of the lining 28 may be provided with a bevel on the inside. It is also pointed out that the lining 28 does not absolutely have to be fastened at both ends. Fixation at only one axial end may be sufficient especially in the case of a relatively rigid consistency and/or if the lining 28 is not too long in the axial direction. However, a true fixation of the position should be ensured there in this case, e.g., by clamping.

Concerning the fastening of the flame retention baffle plate 22, the webs 20 widen radially in the inward direction at their free end, so that the plate 22 can be welded on there with ease.

FIG. 14 shows that even though the lining 28 is cylindrical as a whole, it has a continuous slot in the axial direction and in the radial direction at one point of its circumference. A projection 70 extending in the axial longitudinal direction of the combustion chamber 2 is correspondingly provided on the inside at the circumferential limiting wall 8. When the lining 28 is pushed in the axial direction, the projection 70 ensures that the lining 28 will be aligned in a defined position in terms of its angular position around the longitudinal central axis 14, and that the lining 28 is fixed against displacements in the circumferential direction. This alignment guarantees that the opening 30 of the lining 28 is in the correct position in relation to the socket 12 for the glow plug. It is pointed out that the slot in the lining 28 does not have to be completely continuous in the radial direction, but it is possible to provide, e.g., only an axially extending groove in the outside of the lining. It is also possible as an alternative to provide the lining with an axially extending projection on the outside and to correspondingly provide an axially extending groove on the inside of the circumferential limiting wall 8.

FIGS. 13 and 14 also show that a fuel distribution channel 72, which extends in the circumferential direction and is formed by a flat groove-like depression in the material of the combustion chamber component, is present on the inside of the circumferential limiting wall 8. The distribution channel 72 extends circularly practically over the entire circumference in the exemplary embodiment shown. However, it is possible to provide the distribution channel 72 only over a part of the circumference, especially over the part of the circumference from the fuel supply pipe 74 to be described below to the area of the socket 12 for the glow plug or the opening 30 in the lining 28. It is pointed out that it is possible, as an alternative, to provide the distribution channel 72 on the outer circumference of the lining 28 instead of in the material of the combustion chamber component.

The fuel supply pipe 74 cast integrally on the combustion chamber component is aligned essentially in the circumferential direction of the circumferential limiting wall 8. As a consequence, fuel is supplied in such a direction that it flows farther smoothly in the distribution channel 72 and, distributed over a larger surface, it enters the lining 28 from behind.

Finally, it is pointed out that unlike in the embodiment according to FIG. 1, the socket 12 for the glow plug in the embodiment according to FIGS. 13 and 14 is aligned such that its longitudinal central axis 16 is located essentially or exactly in a plane that extends at right angles to the longitudinal central axis 14 of the combustion chamber 2 (drawing plane of FIG. 14).

Figure 15:
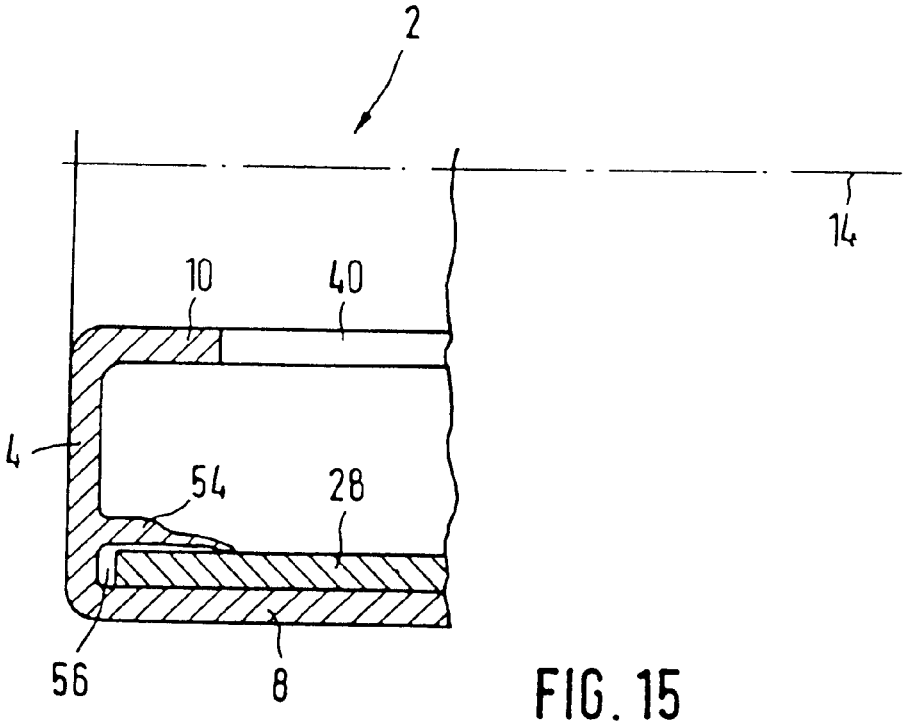
FIG. 15 is a longitudinal sectional view of a variant of the combustion chamber according to FIG. 13, which shows part of the combustion chamber.

FIG. 15 shows a variant in which the fixing ring 54 has a relatively thin wall thickness in its right-hand, free end area and has been bent off radially to the outside after the end of the lining has been pushed in to clamp the lining 28. The annular gap 56 may be somewhat larger in the radial direction than the thickness of the lining 28 without any problem. The end area of the fixing ring 54 can be bent off without problem by means of a tool introduced into the combustion chamber 2 from right to left, which has, e.g., an outer oblique surface to apply a bending pressure.

Figure 16:
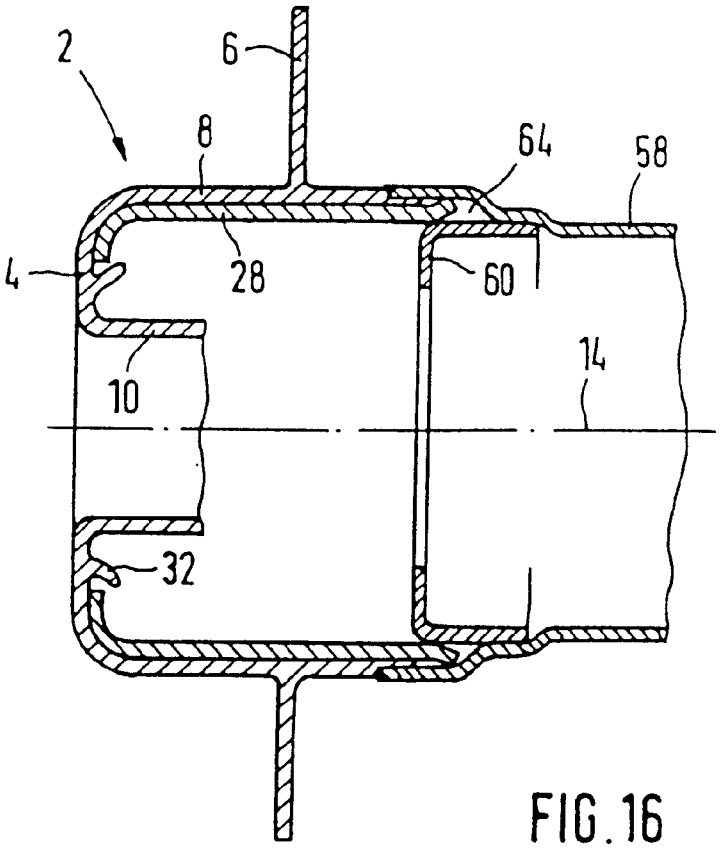
FIG. 16 is a longitudinal sectional view of another variant of the combustion chamber according to FIG. 13, which shows part of the combustion chamber.

FIG. 16 shows an exemplary embodiment in which the lining 28 is again pot-shaped, and thus similar to FIG. 1. However, FIG. 16 illustrates the case in which the end of the lining 28 that is farther away from the front limiting wall 4 is fixed in an annular gap 64 in a particularly favorable manner. The annular gap 64 is formed between a flame tube 58 joining the combustion chamber 2 and a flame screen component 60 fastened to the flame tube 58. The end of the lining 28 that is the right-hand end in FIG. 16 comes to lie in the annular space 64 described when the flame tube 58 is pushed in the axial direction onto the end of the combustion chamber component 2 that is the right-hand end in FIG. 16, and it is clamped by a slight bending between the end area of the circumferential limiting wall 8 and the flame screen component 60 acting as a fixing ring. The flame tube 58 is welded to the combustion chamber component 2.

A ring 32 extends from the front limiting wall 4 to the inside of the combustion chamber 2, but obliquely in the radially outer direction. The internal diameter of the central opening of the lining 28, which opening is associated with the front limiting wall 4, is slightly larger than the diameter of the ring 52 at its free end. As a consequence, it was possible to push the lining 28 easily into the combustion chamber component 2 in the axial direction from right to left in FIG. 16. Aside from the described mechanical fixation at the right-hand end, the lining 28 is fastened to the circumferential limiting wall 8 and to the front limiting wall 4 with a few welding spots. The described oblique shape of the ring 32 offers the advantage that fuel that is possibly dripping off from the end area of the lining 28, which is the left-hand end area in FIG. 16, is channeled in the groove formed by the ring 32 such that it will not drip onto the air supply pipe 10. The function of the ring 32 is thus very similar to that of the guard ring 32 in the exemplary embodiment according to FIG. 1.

However, the ring 32 may also extend simply in the axial direction, which is easier to embody in terms of casting technology. Finally, it is possible to work with a ring 32 that extends axially in the freshly cast state and is bent over in its free end area to the outside against the lining 28 after the lining 28 has been pushed in. In this case, the lining 28 extends at its left-hand end farther in the direction of the central axis 14 of the combustion chamber 2. The ring 32 now represents a fixing ring for the lining 28.

It is pointed out that the fixing ring 54 and/or the fixing ring 66 or 68 does not have to extend continuously over the entire circumference, but it may be divided into sections located at circumferentially spaced locations from one another. This divided design even offers advantages concerning the clamping of the lining 28 by bending over areas of the material.

Figure 17:
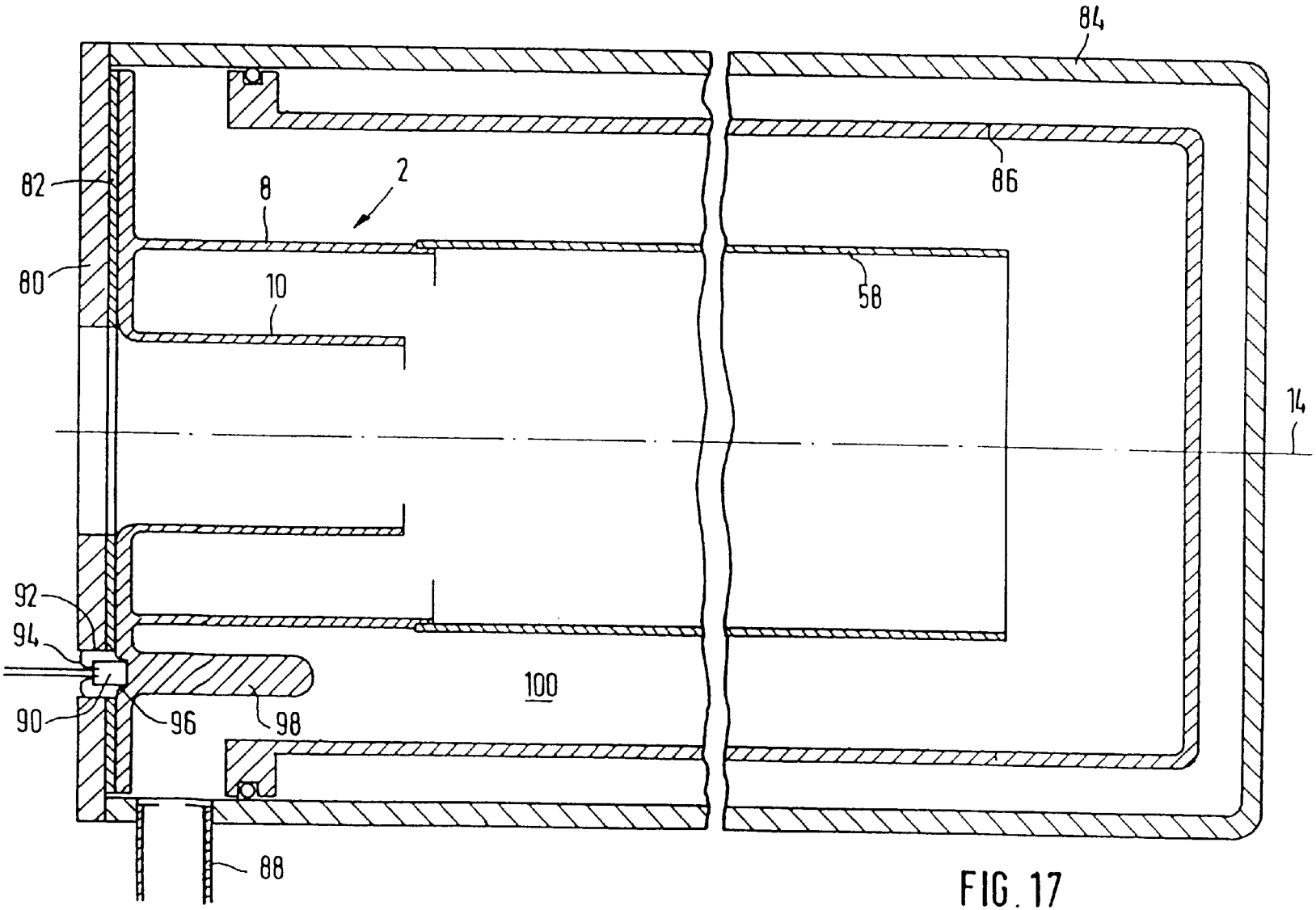
FIG. 17 is the longitudinal sectional view of a vehicle heater with a combustion chamber component of another design.

FIG. 17 schematically shows a combustion chamber precision casting component 2, installed in a vehicle heater. Besides the precision casting component, one can recognize the flame tube 58 forming a continuation of the circumferential limiting wall 8 of the combustion chamber 2, a part of the housing 80 of the combustion air blower, which is screwed to the precision casting component via a seal 82 on its left-hand front side, a jacket 84 of the heater, a heat exchanger wall 86, which separates the space in which the combustion takes place from a space through which water flows within the jacket, and a waste gas pipe 88, through which the combustion waste gases flow from the heater.

A temperature sensor 90 of a common, prior-art design, e.g., model PT 1000, is placed from the left-hand, outer front side into a depression of the precision casting component. The blower housing 80 has a through hole 92 at the site of installation of the temperature sensor 90. The temperature sensor 90 is fastened by means of a spring clip 94, which is fastened to the blower housing 80, and is pressed against the material of the precision casting component.

In the area of the precision casting component in which the depression 96 for the temperature sensor 90 is located, the precision casting component has on the inside an integrally cast heat conduction finger 98, which extends in the axial direction from its root at the front wall of the precision casting component. In practice, the heat conduction finger 98 has an axial length in the range of 20% to 90% of the axial length of the circumferential limiting wall 8.

If the combustion flame goes out due to, e.g., a disturbance, and no more fuel is therefore burned, the temperature decreases in the annular space 100 between the circumferential limiting wall 8 or the flame tube 58, on the one hand, and the heat exchanger wall 86, on the other hand. This reduction in temperature is transmitted by the heat conduction finger 98 to the site of the temperature sensor 90. When the temperature drops below a certain threshold value, the heater, and primarily the supply of fuel to the heater is switched off. It can also be recognized by means of the temperature sensor 90 whether the heater has correctly ignited after the start, because ignition of the fuel having evaporated in the combustion chamber is manifested in an increase in temperature in the annular space 100 described in a short time.

To provide a burner for the thermal regeneration of an exhaust gas particle filter, the combustion chamber 2 according to the present invention, e.g., the combustion chamber 2 according to FIG. 1, can be inserted into the particle filter housing on its front side and be complemented with a fuel pump and a combustion air blower to form the burner. In the case of a vehicle heater, it is normally joined, frequently by a diaphragm-like reduction in the cross-sectional area, by a flame tube, whose axial length is longer than the combustion chamber 2. The hot waste gas flow is deflected by 180° to the outside at the end of the flame tube, and it flows in the axial direction past the tubular partition of a heat exchanger before it is discharged into the atmosphere via a waste gas line. The medium flowing on the outside of the partition of the heat exchanger is either water, which is thus heated in the vehicle heater, or air, which is thus heated to obtain heating air.

While specific embodiments of the invention have been shown and described in detail to illustrate the application of the principles of the invention, it will be understood that the invention may be embodied otherwise without departing from such principles.

We claim:

1. A burner combustion chamber comprising:

a front limiting wall, a circumferential limiting wall, a socket for accommodating a glow plug and a pipe wall for supplying combustion air, said pipe wall extending from said limiting wall into the combustion chamber, said pipe wall having combustion air outlets, said front limiting wall, said circumferential limiting wall, said glow plug socket and said pipe wall being formed integral as a one piece precision casting component.

2. A combustion chamber according to claim 1, wherein said combustion chamber has a substantially longitudinal extension, said glow plug socket being aligned substantially in parallel to a direction of said longitudinal extension of said combustion chamber, said glow plug socket being designed as a bulge formed in said circumferential limiting wall.

3. A combustion chamber according to claim 1, further comprising a flame retention baffle, said pipe wall having an open end toward an inside of said combustion chamber, said flame retention baffle being the form of a curved plate arranged downstream of said open end.

4. A combustion chamber according to claim 1, further comprising a mounting flange formed integrally in one piece with said precision casting, said mounting flange being located as a continuation of said front limiting wall, radially outwardly of said front limiting wall.

5. A combustion chamber according to claim 1 wherein said combustion air outlets are formed as longitudinal slots extending up to a downstream end of said pipe wall.

6. A combustion chamber according to claim 5, wherein said longitudinal slots each have a width, measured in a circumferential direction of said pipe wall, which is one of constant and increasing over a longitudinal extent of said longitudinal slot toward said downstream end.

7. A combustion chamber according to claim 1, wherein at least one of said combustion air outlets forms circumferential direction swirl means for discharging a flow component in a circumferential direction with respect to said pipe wall.

8. A combustion chamber according to claim 1, wherein said air supply pipe wall tapers in a direction of flow.

9. A combustion chamber according to claim 1, further comprising a porous lining forming a fuel evaporation surface, said porous lining being disposed on one of an inside of said circumferential limiting wall and an inside of both said front limiting wall and said circumferential limiting wall.

10. A combustion chamber according to claim 9, wherein said porous lining is formed of a sintered metal.

11. A combustion chamber according to claim 10, wherein said sintered metal lining is introduced into said combustion chamber in a non-sintered state and is sintered in situ.

12. A combustion chamber according to claim 9, further comprising an annular gap formed adjacent to said circumferential limiting wall, said annular gap being one of circumferentially continuous and divided into sections, at least one end of said lining being fixed in said annular gap.

13. A combustion chamber according to claim 12, wherein said annular gap is formed by a fixing ring, said fixing ring being one of continuous and divided into sections in a circumferential direction.

14. A combustion chamber according to claim 13, wherein said fixing ring is formed as an integral part of said precision casting component.

15. A combustion chamber according to claim 13, wherein said fixing ring includes a free end bent off toward said lining, after said lining is positioned in said precision casting.

16. A combustion chamber according to claim 12, wherein said annular gap is formed by a component fastened to said flame tube joining said combustion chaniber.

17. A combustion chamber according to claim 9, wherein said circumferential limiting wall of said combustion chamber includes a projection extending in a direction of said longitudinal extension of said combustion chamber, said extension for positive locking fixation of said lining against movement in a circumferential direction.

18. A combustion chamber according to claim 9, further comprising a fuel distribution channel, which extends at least over part of a circumference of said circumferential limiting wall, provided at a transition between said circumferential limiting wall and said lining.

19. A combustion chamber according to claim 18, further comprising a fuel supply pipe opening into said fuel distribution channel, said fuel supply pipe being provided for supplying fuel essentially in a circumferential direction.

20. A combustion chamber according to claim 9, wherein said porous lining is formed of a sintered metal and is coated with a copper-containing material on an inner surface thereof.

21. A combustion chamber according to claim 9, wherein said porous lining is formed as a fibrous lining including fibers of a copper-containing material.

22. A combustion chamber according to claim 1, further comprising swirl generating means for discharging a flow component in a circumferential direction of said pipe wall, said swirl generating means being provided in a flow path of said combustion air, upstream of said pipe wall.

23. A combustion chamber according to claim 22, wherein said swirl generating means is formed as one of a part of said precision casting component and part of a housing of a combustion air blower arranged upstream of said combustion chamber.

24. A combustion chamber according to claim 1, further comprising a guide and a guard ring, integrally precision cast with said front limiting wall and extending from said front limiting wall over a distance to an inside of said combustion chamber, said guide and said guard ring being arranged between said circumferential limiting wall and said pipe wall.

25. A combustion chamber according to claim 24, wherein said guide and guard ring have a downstream end area designed for increasing turbulence of gas within said combustion chamber.

26. A combustion chamber according to claim 1, further comprising a heat conduction finger with a conduction finger front located farther in a direction of the longitudinal extension of said combustion chamber toward a downstream end of said combustion chamber than a conduction finger root said heat conduction finger being provided radially outwardly of said circumferential limiting wall; and a temperature sensor for sensing combustion via sensing temperature, said temperature sensor being arranged on an outside of said combustion chamber adjacent to said root of said heat conduction finger.

27. A combustion chamber according to claim 26, wherein said heat conduction finger is part of said precision casting component.

28. A combustion chamber according to claim 1, wherein portions of surfaces of the combustion chamber are provided as copper-containing surfaces.

29. A combustion chamber according to claim 28, wherein:

said copper-containing surfaces include one of an outside surface of said pipe wall, an inside surface of said socket, and an inside surface of said circumferential wall.

30. A combustion chamber according to claim 1, wherein:

said circumferential wall encloses a first and second area, said first area mixing fuel with air and initiating combustion, said second area being arranged adjacent and downstream of said first area and completing combustion, said pipe wall extending into said second area.

31. A combustion chamber according to claim 1, wherein:

said circumferential wall extends further from said front limiting wall than said pipe wall extends from said front limiting wall.

32. A combustion chamber according to claim 31, wherein:

a guard ring extends from said front limiting wall between said front limiting wall and said circumferential wall, said circumferential wall and said pipe wall extends further than said guard ring from said front limiting wall.

33. A combustion chamber according to claim 32, further comprising:

a porous lining forming a fuel evaporation surface, said porous lining being disposed on an inside of said circumferential limiting wall and between said guard ring and said circumferential limiting wall.

34. A process for forming a combustion chamber of a burner, the process comprising the steps of:

providing a mold of a front wall, a circumferential wall extending from said front wall, said circumferential wall enclosing a first and second area, said first area mixing fuel with air and initiating combustion, said second area being arranged adjacent and downstream of said first area and completing combustion, a socket formed with said circumferential wall for accommodating a glow plug and a pipe wall extending from said front wall to said second area for supplying combustion air, said pipe wall having combustion air outlets;

precision casting said front wall, said circumferential wall, said glow plug socket and said pipe wall as an integral one piece precision casting component.

35. A process in accordance with claim 34, wherein:

said precision casting is a lost-wax process.

36. A process in accordance with claim 35, wherein:

said lost-wax process includes said mold being formed around a wax pattern, said wax pattern being melted out of said mold and metal being subsequently filled into said die.

* * * * *